US006899173B2

(12) United States Patent
Harmon et al.

(10) Patent No.: US 6,899,173 B2
(45) Date of Patent: May 31, 2005

(54) SMALL TUBULAR WINDOW SYSTEM

(75) Inventors: Stephen K. Harmon, Houston, TX (US); Roy E. Swanson, Jr., Sugar Land, TX (US); Marc D. Kuck, Anchorage, AK (US)

(73) Assignee: Baker Hughes Incorporated, Houston, TX (US)

( * ) Notice: Subject to any disclaimer, the term of this patent is extended or adjusted under 35 U.S.C. 154(b) by 129 days.

(21) Appl. No.: 10/231,777

(22) Filed: Aug. 28, 2002

(65) Prior Publication Data

US 2003/0070801 A1 Apr. 17, 2003

Related U.S. Application Data

(60) Provisional application No. 60/329,932, filed on Oct. 17, 2001.

(51) Int. Cl.[7] ..... E21B 7/08

(52) U.S. Cl. ..... 166/117.5; 166/313; 175/80

(58) Field of Search ..... 166/55.6, 50, 117.5, 166/117.6, 384, 313, 298; 175/80, 82

(56) References Cited

U.S. PATENT DOCUMENTS

| | | | | |
|---|---|---|---|---|
| 2,897,898 | A | | 8/1959 | Wynn |
| 5,193,620 | A | | 3/1993 | Braddick |
| 5,195,591 | A | | 3/1993 | Blount et al. |
| 5,222,554 | A | * | 6/1993 | Blount et al. ..... 166/117.6 |
| 5,423,387 | A | | 6/1995 | Lynde |
| 5,458,196 | A | | 10/1995 | George et al. |
| 5,467,819 | A | | 11/1995 | Braddick |
| 5,494,111 | A | | 2/1996 | Davis et al. |
| 5,535,822 | A | * | 7/1996 | Schock et al. ..... 166/50 |
| 5,566,762 | A | | 10/1996 | Braddick et al. |
| 5,595,247 | A | | 1/1997 | Braddick |
| 5,647,436 | A | | 7/1997 | Braddick |
| 5,647,437 | A | | 7/1997 | Braddick et al. |
| 5,769,167 | A | | 6/1998 | Braddick |
| 5,836,387 | A | | 11/1998 | Carter |
| 5,860,474 | A | | 1/1999 | Stoltz et al. |
| 5,909,770 | A | | 6/1999 | Davis |
| 5,944,101 | A | | 8/1999 | Hearn |
| RE36,526 | E | | 1/2000 | Braddick |
| 6,167,961 | B1 | | 1/2001 | Pollard |

FOREIGN PATENT DOCUMENTS

| | | |
|---|---|---|
| DE | 1911900 | 9/1970 |
| GB | 2351100 | 12/2000 |

OTHER PUBLICATIONS

Information Sheets from Weatherford Enterra, "Thru–Tubing System Whipstock Concave", 6 pages, date unknown.

Weatherford Product Specifications, "Thru–Tubing Window System–Milling Anchor", "Thru–Tubing Window System–Whipstock Concave", "Thru–Tubing Window System Orientation Anchor", 3 pages, Aug. 1995.

TIW TTR Window Milling information, "New Design Thru–Tubing Retrievable Whipstock Integrated with Inner String Liner Cement Concept", presented by Britt O. Braddick at the Sixth International Conference on Coiled Tubing & Well Intervention, 11 pages, Feb. 9–11, 1998.

(Continued)

*Primary Examiner*—Frank Tsay
(74) *Attorney, Agent, or Firm*—Steve Rosenblatt

(57) ABSTRACT

A through tubing retrievable whipstock and installation method is disclosed. In the preferred embodiment, a plurality of anchor links pivot at one end and have wickers on an opposed rounded end. The links are configured to deliver an optimum contact angle with respect to the longitudinal axis of the whipstock in a variety of casing sizes and weights. A lock ring system holds the set position and the upper end is hinged and biased to stay out of the way of the mill or mills and yet be easy to engage by a retrieving tool.

20 Claims, 7 Drawing Sheets

OTHER PUBLICATIONS

TIW TTR Window Milling System information, 15 pages, 1995.

Baker Hughes, Baker Oil Tools, Product Report, Thru–Tubing Whipstock Restricted Bore Applications Product Family Nos. H15050 and H15076, Jul. 2001, 2 pages.

Baker Hughes, Baker Oil Tools, Product Report, Coiled Tubing Whipstock (Monobore Applications), Product Family No. H15043, Mar. 2001, 2 pages.

TIW TTR Window Milling System Information, 3 pages, date unknown.

* cited by examiner

SMALL TUBULAR WINDOW SYSTEM

PRIORITY INFORMATION

This application claims the benefit of U.S. Provisional Application No. 60/329,932 on Oct. 17, 2001.

FIELD OF THE INVENTION

The field of this invention is through tubing retrievable whipstocks, which can be set in the hole below the tubing, preferably in casing of various sizes.

BACKGROUND OF THE INVENTION

The ability to set a whipstock through tubing for milling a window for a lateral is a great time saver. The tubing doesn't need to be pulled and the resultant time saving translates into substantial cost savings. Various designs of through-tubing whipstocks have been developed, the earlier ones not being retrievable and the later ones incorporating a retrievable feature. U.S. Pat. No. 5,909,770 entitled Retrievable Whipstock uses a pair of pivoting links each connected to a common tension bar, which is pulled up relative to the whipstock body by a known setting tool. The set is held by wedges, which must be undermined to release the whipstock. The tension bar has wickers to dig into the casing below the tubing. In this tool, the best results were obtainable if the angle the pivoting links made with the longitudinal axis of the whipstock was less than about 60-70 degrees. The problem with the tool arose if it were to be used in different size casing. Even casing of the same size but different wall thickness could allow for link rotation in excess of the desired maximum. In response to this issue either adjustable length links were used which had to be correctly set for the anticipated casing condition at the anticipated whipstock location or spare links of the desired length had to be on hand and installed before running in the hole. This turned out to be inconvenient and somewhat imprecise. Accordingly one of the objectives of the present invention is to allow a single tool to set in a variety of internal diameters, with variations in excess of 1.5 inches. Additionally, a simply designed and reliable locking and release system is another objective of the present invention. Furthermore, a more reliable structure to facilitate retrieval while being maintained out of the way of the mill or mills is another objective of the present invention. To accomplish these objectives, some of the features of the present invention comprise specially shaped anchoring links, which anchor through edge wickers. The anchoring links are rotated into position by a tension rod system whose set position is secured with a simple and reliable locking ring system, which is selectively released. The upper end is hinged and biased to stay out of harms way during milling. These and other features of the present invention will become more readily apparent to one skilled in the art from a review of the detailed description of the preferred embodiment, which appears below.

Relevant whipstock patents include U.S. Pat. Nos.: 5,494,111; 5,195,591; 5,944,101; 5,860,474; 5,423,387; 6,167,961; Re 36,526; 5,796,167; 5,647,437; 5,595,247; 5,566,762; 5,467,819; 5,193,620; 5,647,436; 5,836,387. Also relevant are Baker Oil Tools Products H15050; H15076; H15043 and the TIW TTR Window Milling System and Weatherford Enterra's Thru-Tubing Window Milling System featuring the Pawl Locking System.

SUMMARY OF THE INVENTION

A through tubing retrievable whipstock and installation method is disclosed. In the preferred embodiment, a plurality of anchor links pivot at one end and have wickers on an opposed rounded end. The links are configured to deliver an optimum contact angle with respect to the longitudinal axis of the whipstock in a variety of casing sizes and weights. A lock ring system holds the set position and the upper end is hinged and biased to stay out of the way of the mill or mills and yet be easy to engage by a retrieving tool.

DETAILED DESCRIPTION OF THE DRAWINGS

FIGS. 1*a*–1*d* are an elevation view in section of the tool in the run in position;

FIGS. 2*a*–2*d* are the view of the tool from FIGS. 1*a*–*d* but in the set position;

FIGS. 3*a*–3*d* show and alternative set position rotated 180 degrees from FIGS. 2*a*–2*d;*

FIGS. 4*a*–4*d* show the tool in the released position;

FIG. 5 is a section through lines 6—6 in FIG. 1*a;*

Figure 7:
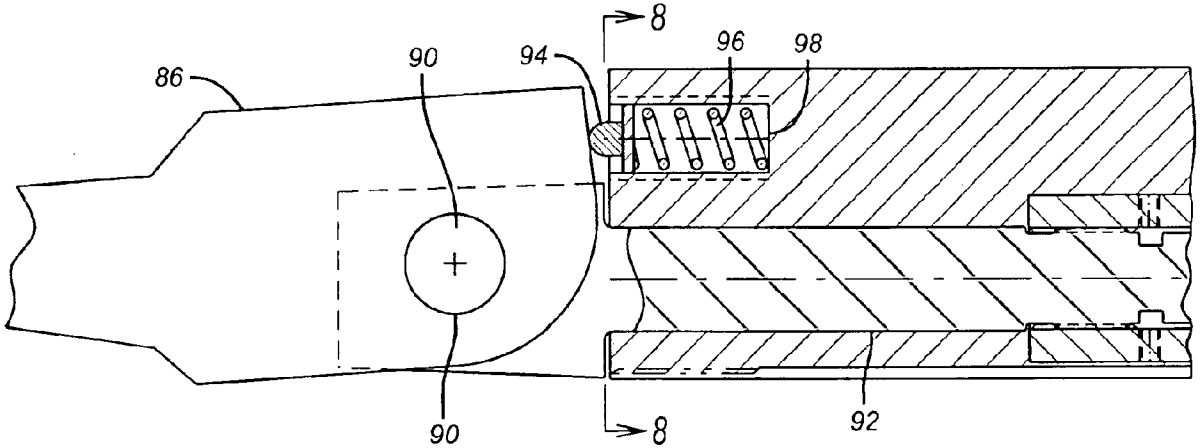
FIG. 7 is a detailed view of the hinged top shown in section.
Figure 7A:
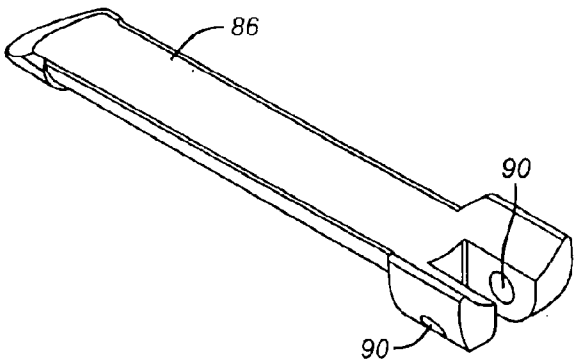

FIG. 7*a* is a perspective view of the hinged top segment shown in FIG. 7.

Figure 8:
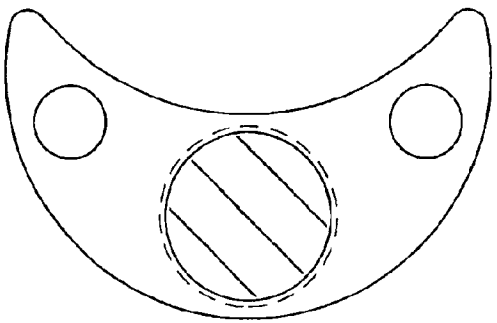
Figure 9:
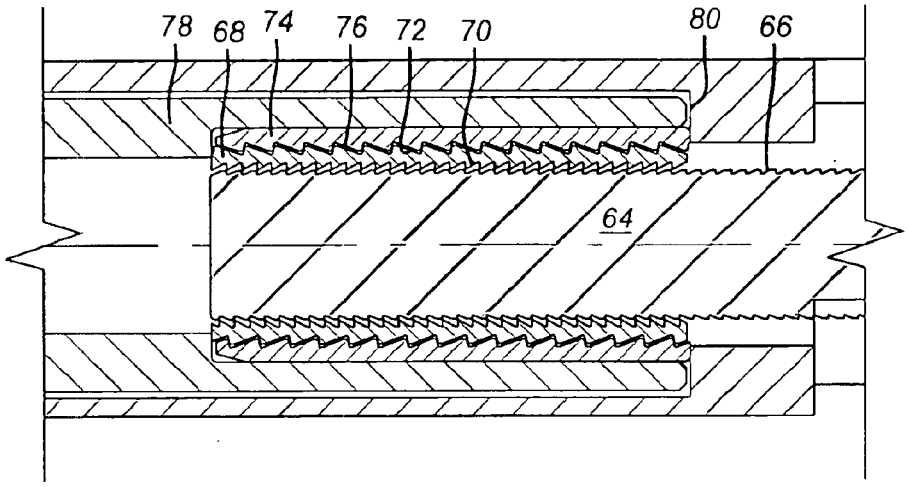
Figure 10:
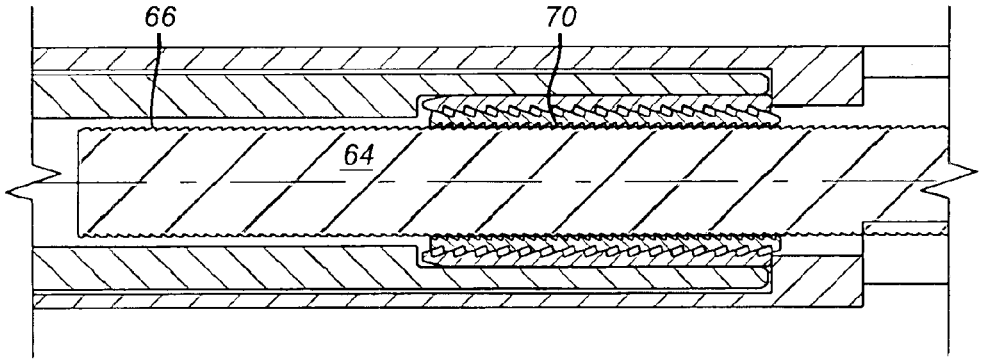

FIG. 8 is a view through section lines 8—8 of FIG. 7;

FIG. 9 is a section view of the locking system in the run in position;

FIG. 10 is the view of FIG. 9 with the tool in the set position; and

Figure 11:
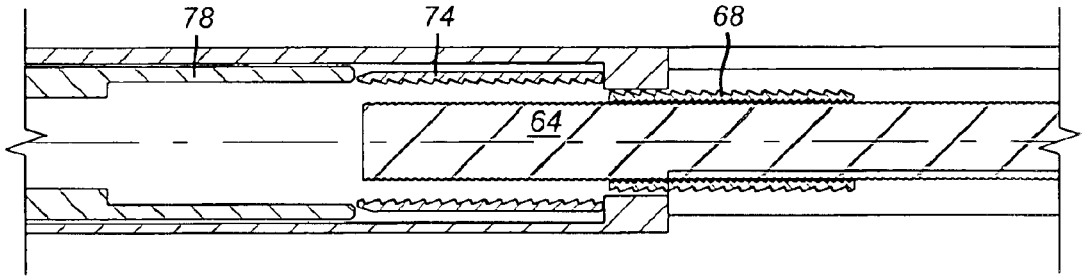

FIG. 11 is the view of FIG. 10 with the tool in the released position.

DETAILED DESCRIPTION OF THE PREFERRED EMBODIMENT

Referring to FIGS. 1*a*–1*d,* the whipstock 10 has a lower end 12. Anchor links 14 and 16 are respectively pinned at pins 18 and 20. In the run in position shown in FIG. 1*d,* being disposed in the recess 22 of whipstock 10 protects the links 14 and 16. This allows whipstock 10 to be advanced through tubing (not shown) without risk of snagging the links 18 and 20, which could result in a premature anchoring of the whipstock 10. Links 14 and 16 are respectively pinned at pins 24 and 26 to tension rod 28. Pins 14 and 16 are disposed on a common centerline 30 which is offset from centerline 32 on which are located pins 24 and 26. When an uphole pull is exerted on tension rod 28 while holding the whipstock 10 fixed, this offset in centerlines 30 and 32, creates a rotation of links 14 and 16 about their respective pin mounts 24 and 26, as shown in FIG. 2*d.* Those skilled in the art will appreciate that the length of tension rod 28 may be adjustable. The location of the pins 24 and 26 on their respective links 14 and 16 can be altered. A greater or less number of links, such as 14 can be used. Links such as 14 or 16 can be individually actuated rather than actuated in tandem, although the tandem actuation takes fewer moving parts and is therefore more compact and will operate more reliably. Although the links 14 and 16 are shown to have an elongated shape, they can have other shapes and can be urged to the set position in equivalent ways to use of a tension rod 28.

Referring again to FIG. 2*d,* links 14 and 16 each respectively have a dog leg portion 34 and 36 which is has an offset in its longitudinal axis respectively from the upper portion 38 and 40. Each dogleg portion has respectively a lower arcuate segment 42 and 44, which can be its edge surface, and on which there is respectively a set of wickers 46 and 48.

Typically, a point of contact 50 will define dashed line 52, which extends from a pivot pin such as 20. It is desirable to keep the angle between dashed line 52 and centerline 30 in the preferred angle range of about 60–70 degrees. Since the whipstock 10 will be used in a variety of casing weights and even different sizes, it is possible to obtain the optimum angle between lines 52 and 30 for a range of casing sizes by controlling several variables. One is the radius of the arc on which the wickers 46 or 48 will contact the casing. Another variable is the length of a given link from its pin, such as 18 to its projected contact point 50 with the casing. Yet another variable, which is related to the overall link length, is the degree of offset from an upper portion such as 38 and a dogleg portion, such as 34. When this geometry problem is solved, the optimum angle between lines 52 and 30 of about 60–70 degrees can be achieved with casing internal variations in different installations of 1.5 inches and more. For example, a single unit can be set in 7 inch casing weighing 39 pounds per foot to 7⅝ inch casing weighing 29.8 pounds per foot with no adjustments or part change-outs. An even broader range of casing sizes can be serviced with a single tool, without alteration. This flexibility makes the whipstock 10 more versatile and reduces the chance for slippage during window milling due to an insufficient grip. Those skilled in the art realize that casing condition at the point of support for the whipstock 10 can be variable. This makes it difficult to know the precise inside casing diameter at the fixation point. The rounded portions, such as 42, on dogleg segment 34, compensate for such variability to allow for the optimum grip using the preferred angular relationship between lines 30 and 52.

The structure and operation of the setting mechanism will now be described. The tension rod 28 extends along the whipstock 10 on its back side (i.e. opposite from where the milling will take place) and has wedges 54 and 56 connected to it. These wedges will ride on sloping surfaces 58 and 60 to cause rotation of links 14 and 16 when the tension rod 28 is pulled up relative to whipstock 10, see FIGS. 2*b* and 2*c*. The upper end 61 of the tension rod 28 terminates in transfer block 62(see FIG. 2*a*). A locking mandrel 64(see FIGS. 2*a* and 9), which is simply a rod with ratchet teeth 66, extends up-hole from transfer block 62. Body lock ring 68 has internal serrations 70 and external serrations 72. It is a longitudinally split ring, the split not being shown in FIG. 9. Locking sleeve 74 has internal serrations 76 and is also longitudinally split but the split is not shown in FIG. 9. Locking sleeve 74 is mounted over lock ring 68. Body lock housing 78 is mounted over locking sleeve 74 (see FIGS. 2*a* and 9) and secures locking sleeve 74 to shoulder 80 on whipstock 10. During setting, the transfer block 62 is urged uphole, taking with it locking mandrel 64 and tension rod 28. Lock ring 68 is prevented from moving uphole because serrations 72 engage serrations 76. However serrations 70 allow serrations 66 on locking mandrel 64 to ratchet up, but not back down. FIG. 10 shows the set and locked position.

Release occurs when the body lock housing 78 is pulled up, undermining support for locking sleeve 74. Locking sleeve 74 is substantially weaker than locking ring 68. The released tension due to retraction of lock housing 78 forces locking sleeve 74 to open up radially because it has a longitudinal split. It could also simply fail by developing another longitudinal split. As shown in FIG. 11, the locking ring 68 merely stays with locking mandrel 64 as it moves downhole. Links 14 and 16 can now rotate back to the position of FIG. 1*d* immediately or upon upward movement of the whipstock 10 with a retrieving tool (not shown).

Figure 6:
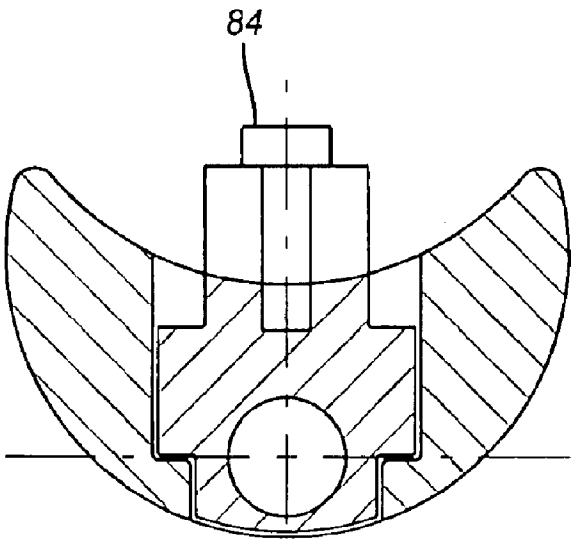
Figure 5:
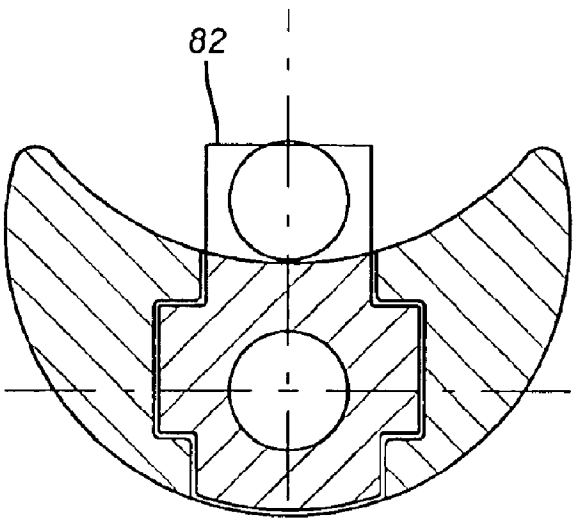
FIG. 5 is a section through lines 5—5 in FIG. 1*a;*

This locking system is simple and reliable and releases more easily than prior lock systems, which used rotating lock dogs such as U.S. Pat. No. 5,909,770. The locking system is simple to actuate with a known setting tool as is illustrated in FIGS. 5 and 6. FIG. 5 illustrates that a known setting tool 82 is releasably attached to the transfer block 62 with a mechanism 84 which fails in shear after pulling up the transfer block 62, while preventing whipstock 10 from moving uphole, until transfer block 62 can no longer move due to contact of links 14 and 16 with the casing (not shown).

Figure 1A:
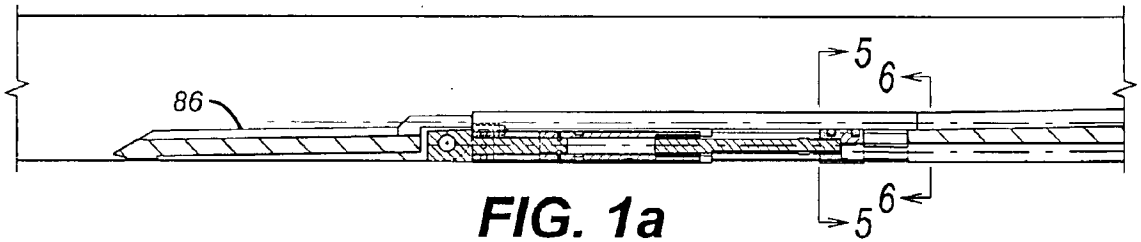
Figure 2A:
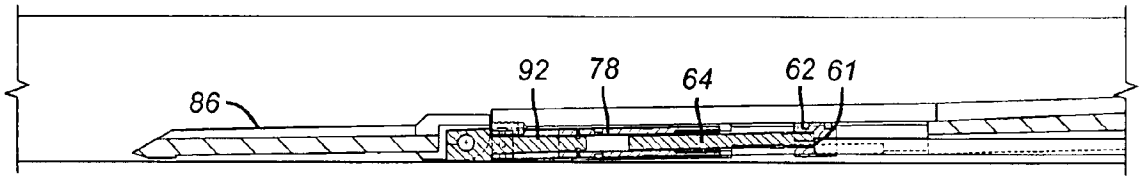
Figure 3A:
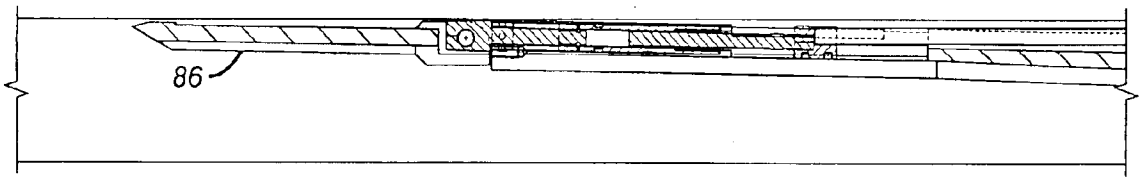
Figure 4A:
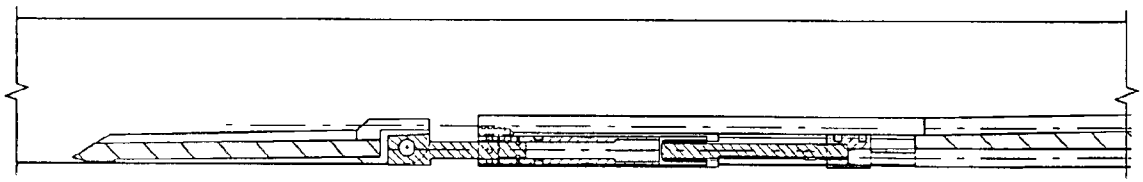
Figure 1B:
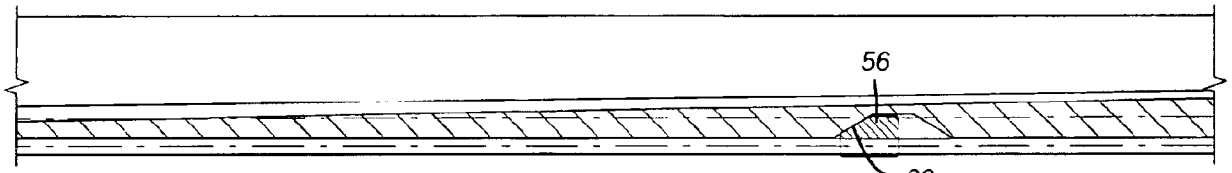
Figure 2B:
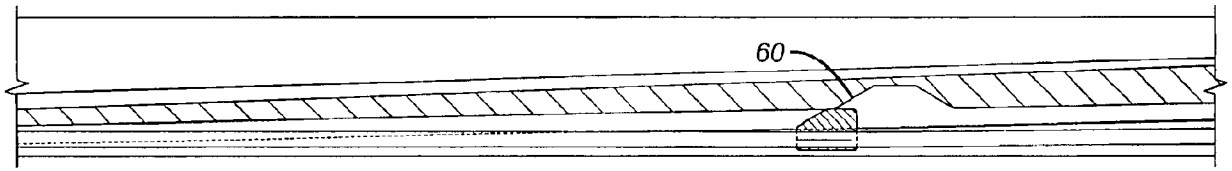
Figure 3B:
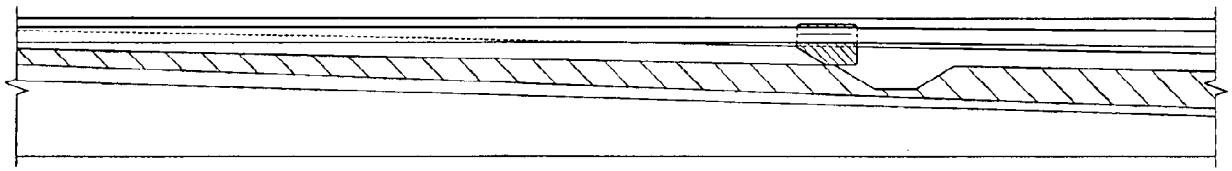
Figure 4B:
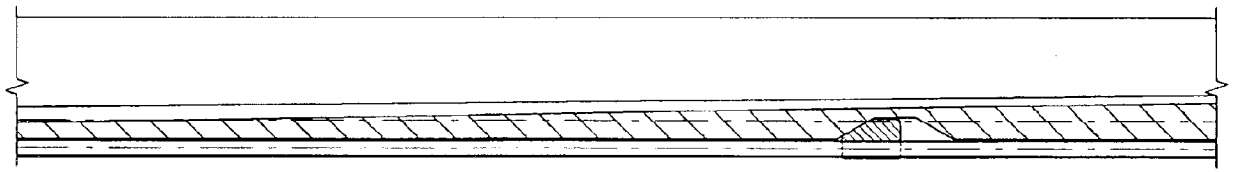
Figures 1C, 2C, 3C, 4C:
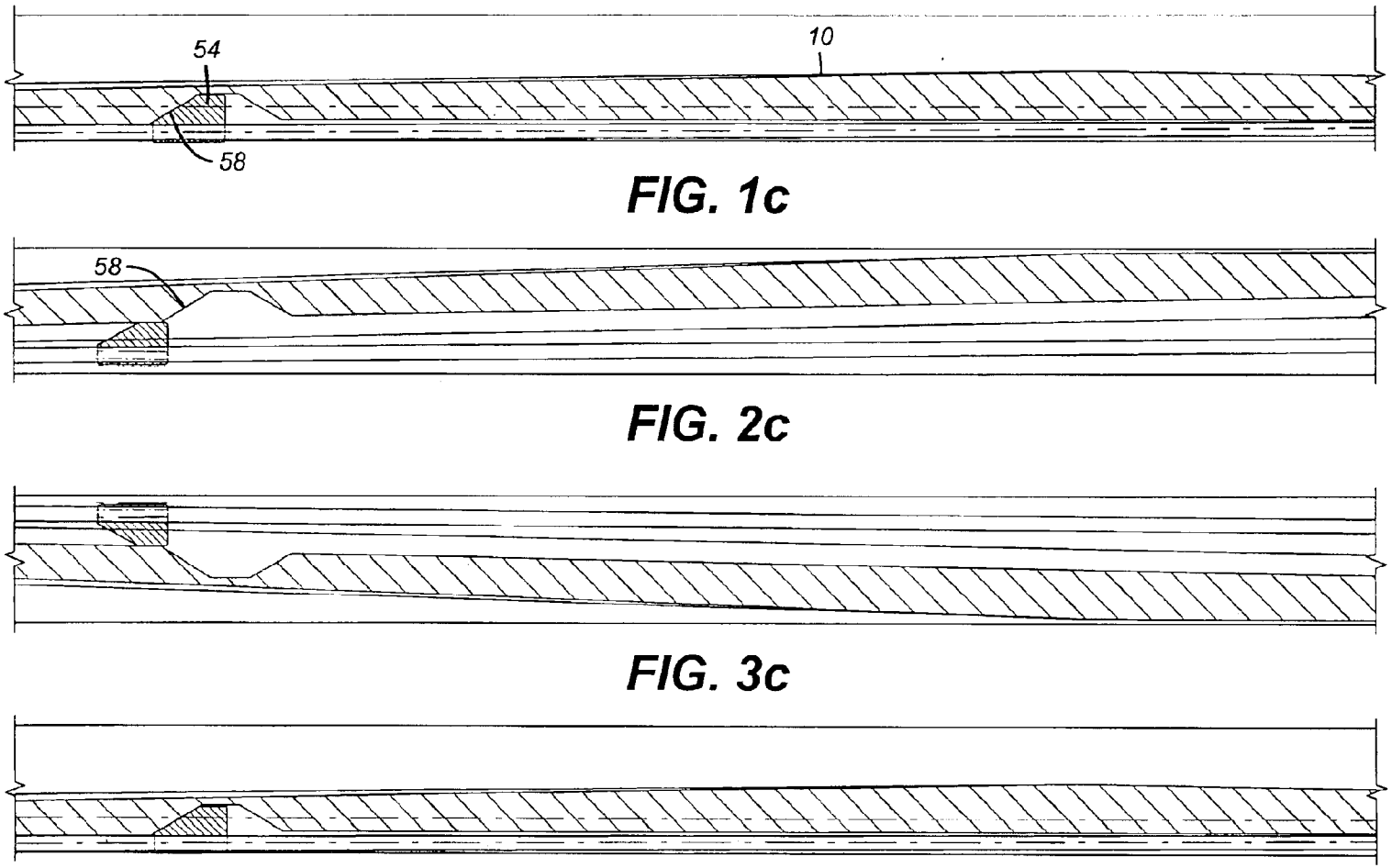
Figure 1D:
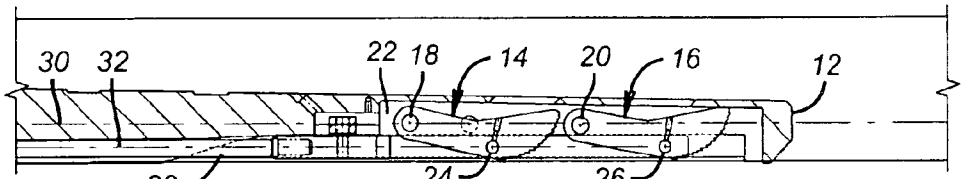
Figure 2D:
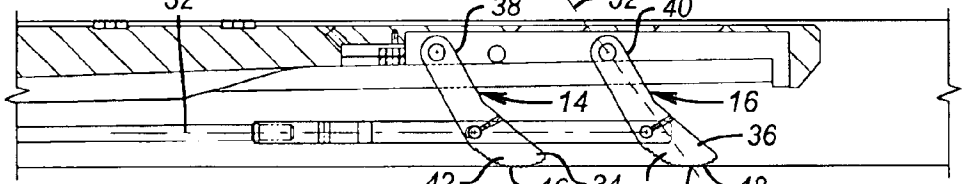
Figure 3D:
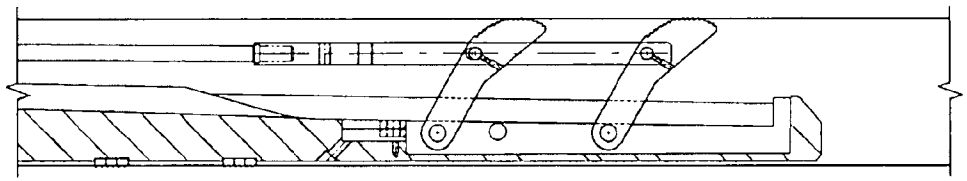
Figure 4D:
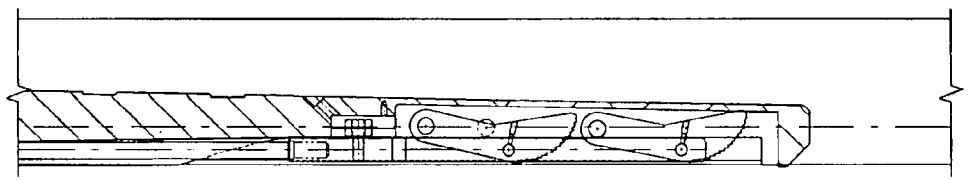

FIGS. 2*a* and 3*a* show that various orientations for the set position can be obtained. If the whipstock 10 is set in a horizontal lateral, the whipstock 10 can be anchored for a window to be milled looking up (FIG. 2*a*) or looking down (FIG. 3*a*) or any other position in between, using a known MWD tool to determine the whipstock orientation downhole from the surface.

Another feature of the present invention is the hinged top segment 86 (see FIGS. 2*a* and 7). It is attached by a pin 88 extending through holes 90 (see FIG. 8) to mandrel 92, which is in turn screwed to body lock housing 78. Plungers 94 each biased by a spring 96 disposed in recess 98 exert a force offset from pin 88 so as to put a rotational force on top segment 86. Again, if FIG. 2*a* is a horizontal lateral, plungers 94 keep the top segment down at the bottom to keep it out of harms way during milling. The springs 96 only offset the weight of the top segment 86 and beyond that apply a slight residual force to hold it out of the way of the mill. At the same time, the hinged upper segment is easy for the retrieving tool to pry up so that an upward force can be applied to top segment 86 to move up body lock housing 78 and effect the release as described above. In FIG. 3*a,* the biased top segment 86 is held from falling down into the path of the mill but not with so much force as to preclude the release tool from easily getting under top segment 86 to get the needed grip on it for the release of the whipstock 10. Those skilled in the art will appreciate the difficulty in getting the release tool to grip the top of the whipstock 10, if there were no hinged top segment 86. The stiffness of the whipstock would hold the upper end to the casing wall with a sufficient force so as to potentially prevent the retrieving tool from getting it lifted off the casing wall to get under it for a grip. Those skilled in the art will appreciate that the hinged top segment 86 can be replaced with different connections or eliminated altogether in favor of a thinned portion near the upper end of the whipstock 10, itself, to give the upper end the required flexibility.

Those skilled in the art will now appreciate the various advantages of the present invention. The anchor system is usable in a range of casing sizes without adjustment. It can compensate for casing wear and allows the force to be retained radially, making the unit less susceptible to release from vibration or shock. Prior systems, which distributed the anchor force equally radially in all directions, had no mechanism for dealing with inside wall dimensional irregularities that arose from casing wear. Cement was squeezed past the anchor on those prior designs to beef up the holding force. Any window orientation can be accommodated with the aid of the hinged flexible upper segment. Links 14 and 16 provide progressive contact with a tooth profile that digs into the casing wall.

While the preferred embodiment has been described above, those skilled in the art will appreciate that other mechanisms are contemplated to accomplish the task of this invention, whose scope is delimited by the claims appended below, properly interpreted for their literal and equivalent scope.

We claim:

1. A casing whipstock, comprising:

an elongated tapered body;

at least one anchor link mounted to said body, said link having an end that moves into anchoring engagement with the casing along a non-linear surface of said anchor link.

2. The whipstock of claim 1, further comprising:

an actuator mounted to said body and operably connected to said link to pivot it from a retracted to an extended position where it contacts the casing; and a lock assembly circumscribing said actuator to selectively hold its position with said anchor link engaged to the casing.

3. The whipstock of claim 2, wherein:

said at least one anchor link comprises a plurality of links connected to said actuator for tandem movement.

4. The whipstock of claim 1, wherein:

said anchor link is pivotally mounted.

5. A casing whipstock, comprising:

an elongated tapered body;

at least one anchor link mounted to said body, said link having an end that moves into anchoring engagement with the casing along a non-linear surface thereof;

said body comprises a flexible end which is sufficiently strong to keep said end away from a mill during window milling and flexible enough to allow a retrieving tool to grip it for release of said anchor link.

6. The whipstock of claim 5, wherein:

said flexible end further comprises a pivotally mounted tip segment.

7. The whipstock of claim 6, further comprising:

a biasing member mounted to said body to bias said tip segment toward the casing.

8. A casing whipstock, comprising:

an elongated tapered body;

at least one anchor link mounted to said body, said link having an end that moves into anchoring engagement with the casing along a non-linear surface thereof;

an actuator mounted to said body and operably connected to said link to pivot it from a retracted to an extended position where it contacts the casing; and a lock assembly circumscribing said actuator to selectively hold its position with said anchor link engaged to the casing;

said actuator comprises a rod and said lock comprises at least one ring having serrations on at least one side thereof.

9. The whipstock of claim 8, wherein:

said rod comprises serrations on an outer surface thereof;

said at least one ring comprises an inner ring contacting said rod and an outer ring surrounding said inner ring.

10. The whipstock of claim 9, wherein:

said inner and outer ring are mounted within a movable sleeve.

11. The whipstock of claim 10, wherein:

said inner and outer rings are cylindrically shaped and longitudinally split;

said inner ring is serrated on opposed sides;

said outer ring is serrated on its face contacting said inner ring, such that with said movable sleeve in place, said rod can be moved to put said anchor link in locking contact with the casing.

12. The whipstock of claim 11, wherein:

said locking contact is released by moving said movable sleeve so as to undermine support for said outer ring.

13. The whipstock of claim 12, further comprising:

a flexible end on said body and operably connected to said movable sleeve.

14. The whipstock of claim 13, wherein:

said flexible end comprises a pivotally mounted tip biased from said body toward the casing.

15. A casing whipstock, comprising:

an elongated tapered body;

at least one anchor link mounted to said body, said link having an end that moves into anchoring engagement with the casing along a non-linear surface thereof;

said anchor link is pivotally mounted;

said anchor link is not elongated.

16. A casing whipstock, comprising:

an elongated tapered body;

at least one anchor link mounted to said body, said link having an end that moves into anchoring engagement with the casing along a non-linear surface thereof;

said anchor link is pivotally mounted;

said anchor link further comprises a bend.

17. A casing whipstock, comprising:

an elongated tapered body;

at least one anchor link mounted to said body, said link having an end that moves into anchoring engagement with the casing along a non-linear surface thereof;

said anchor link is pivotally mounted;

said body comprises a longitudinal axis, and said anchor link comprises at least one longitudinal axis through said pivotal mounting, wherein said longitudinal axes form an included angle of about 60–70 degrees when said anchor link contacts the casing even if the whipstock is run into different casing having a diameter variability of over 1.5 inches.

18. A casing whipstock, comprising:

an elongated tapered body;

at least one anchor link mounted to said body, said link having an end that moves into anchoring engagement with the casing along a non-linear surface thereof;

said anchor link is pivotally mounted;

said end of said anchor link that contacts the casing comprises at least one arc.

19. A casing whipstock, comprising:

an elongated tapered body;

at least one anchor link mounted to said body, said link having an end that moves into anchoring engagement with the casing along a non-linear surface thereof;

an actuator mounted to said body and operably connected to said link to pivot it from a retracted to an extended position where it contacts the casing; and a lock assembly circumscribing said actuator to selectively hold its position with said anchor link engaged to the casing;

said at least one anchor link comprises a plurality of links connected to said actuator for tandem movement;

said body comprises a flexible end operably connected to said lock assembly for selective release of said actuator.

20. The whipstock of claim 19, wherein:

said flexible end further comprises a pivotally mounted tip biased from said body toward the casing.

* * * * *